US011582848B2

(12) United States Patent
Chiu et al.

(10) Patent No.: US 11,582,848 B2
(45) Date of Patent: Feb. 14, 2023

(54) LED POWER TRANSMISSION LINE WITH LOAD IDENTIFICATION FUNCTION AND LOAD IDENTIFICATION METHOD

(71) Applicant: DELTA ELECTRONICS, INC., Taoyuan (TW)

(72) Inventors: Jui-Lung Chiu, Taoyuan (TW); Chia-Cheng Weng, Taoyuan (TW); Cheng-Hsun Chang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/370,525

(22) Filed: Jul. 8, 2021

(65) Prior Publication Data

US 2022/0346203 A1 Oct. 27, 2022

(30) Foreign Application Priority Data

Apr. 21, 2021 (CN) ..... 202110430048.6

(51) Int. Cl.
*H05B 45/46* (2020.01)
*H05B 47/10* (2020.01)
*H05B 47/105* (2020.01)

(52) U.S. Cl.
CPC ..... *H05B 45/46* (2020.01); *H05B 47/105* (2020.01)

(58) Field of Classification Search
CPC ..... H05B 45/10; H05B 45/30; H05B 45/40; H05B 45/46; H05B 47/10; H05B 47/105
See application file for complete search history.

(56) References Cited

U.S. PATENT DOCUMENTS 10,320,382 B2 * 6/2019 Vogt, IV ..... H03K 17/72
2012/0119661 A1 5/2012 Müller
2017/0353215 A1 * 12/2017 Jang ..... H04B 17/19

FOREIGN PATENT DOCUMENTS

CN 106028554 A 10/2016
CN 107949112 A * 4/2018

* cited by examiner

*Primary Examiner* — Jimmy T Vu
(74) *Attorney, Agent, or Firm* — Muncy, Geissler, Olds & Lowe, P.C.

(57) ABSTRACT

An LED power transmission line with load identification function is coupled to an LED power control apparatus having a plurality of power output ports and an LED load. The LED power transmission line includes a power transmission circuit, a signal transmission circuit, and a memory apparatus. The power transmission circuit transmits a power outputted from the power output port to the LED load. The signal transmission circuit is coupled to a control module of the LED power apparatus through the power output port. The memory apparatus stores an LED specification information related to an electrical specification of the LED load. The LED specification information is provided to the control module through the signal transmission circuit so that the control module limits an output current outputted from the power output port according to the LED specification information.

10 Claims, 3 Drawing Sheets

LED POWER TRANSMISSION LINE WITH LOAD IDENTIFICATION FUNCTION AND LOAD IDENTIFICATION METHOD

BACKGROUND

Technical Field

The present disclosure relates to an LED power transmission line and a load identification method, and more particularly to an LED power transmission line with load identification function and a load identification method.

Description of Related Art

The statements in this section merely provide background information related to the present disclosure and do not necessarily constitute prior art.

In recent years, the development of lighting technology that uses light-emitting diodes (LEDs) as light sources has become increasingly mature, and with the improvement of LED manufacturing process and the increase in production capacity, the manufacturing cost of its hardware has also been reduced year by year. In addition, LED has the advantages of energy saving, long service life and durability, making the application of LED lighting equipment more and more widespread. In contrast, the LED lighting market has an increasing demand for LED power supply systems for supplying and controlling LED power. In general, LED lighting systems usually include LED power supply systems and LED loads (such as LED lamps) equipped with LEDs. The LED power supply system usually includes an LED power control apparatus and an LED power transmission line. The LED power control apparatus supplies power to the LED load through the LED power transmission line to make the LED load emit light and provide lighting capability.

In order to meet the lighting requirements of different applications, various LED loads may have different current specifications. In the configuration adjustment process of the conventional LED lighting system, users usually need to purchase the corresponding LED lamps (loads), and set the output parameters of the corresponding LED power control apparatus according to the current specifications of the LED lamps. For example, the maximum output current of the LED power control apparatus is limited to supply power that meets the specifications to the LED loads. However, if the LED power control apparatus has a plurality of power output ports, the user's process of setting for each power output port is not only cumbersome to manually set, but there may be also a risk of manual setting errors or confusion or loss of the parameters that have been set for each power output port. If the LED load that does not meet the specifications is connected (for example, the current specification is less than the set value of the output current limit), it is easy to cause the LED load to burn out.

Accordingly, the present disclosure provides an LED power transmission line with load identification function and a load identification method to save the user's effort to manually set the output current parameters by himself, and reduce the risk of errors that may be caused by the manual setting process, thereby avoiding over-current damage caused by non-compliant LED loads that are coupled to the LED power control apparatus through the LED power transmission line.

SUMMARY

In order to solve the above-mentioned problems, the present disclosure provides an LED power transmission line with load identification function. The LED power transmission line is coupled to an LED power control apparatus having a plurality of power output ports and an LED load. The LED power transmission line includes a power transmission circuit, a signal transmission circuit, and a memory apparatus. The power transmission circuit is coupled to any one of the power output ports and the LED load, and transmits a power outputted from the power output port to the LED load. The signal transmission circuit is coupled to a control module of the LED power control apparatus through the power output port. The memory apparatus is coupled to the signal transmission circuit, and stores an LED specification information related to the LED load. The control module acquires the LED specification information through the signal transmission circuit, and adjusts an output current outputted from the power output port according to the LED specification information.

In order to solve the above-mentioned problems, the present disclosure provides a load identification method of an LED power transmission line. The LED power transmission line is coupled to any one power output port of an LED power control apparatus having a plurality of power output ports and an LED load. The method includes steps of: providing an LED specification information related to the LED load and stored in a memory apparatus of the LED power transmission line to the LED power control apparatus through the power output port, and providing an output current that meets an electrical specification to the LED load through the power output port.

The main purpose and effect of the present disclosure are to couple the LED power transmission line having the memory apparatus to the control module of the LED power control apparatus and the corresponding LED load so that the control module can acquire the LED specification information, stored in the memory apparatus, corresponding to the LED load. Also, the output current outputted from the power output port is automatically limited according to the LED specification information so as to save the user's effort to manually set the output current parameters by himself, and reduce the risk of errors that may be caused by the manual setting process, thereby avoiding over-current damage caused by non-compliant LED loads that are coupled to the LED power control apparatus through the LED power transmission line.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The present disclosure can be more fully understood by reading the following detailed description of the embodiment, with reference made to the accompanying drawing as follows.

DETAILED DESCRIPTION

Figure 1:
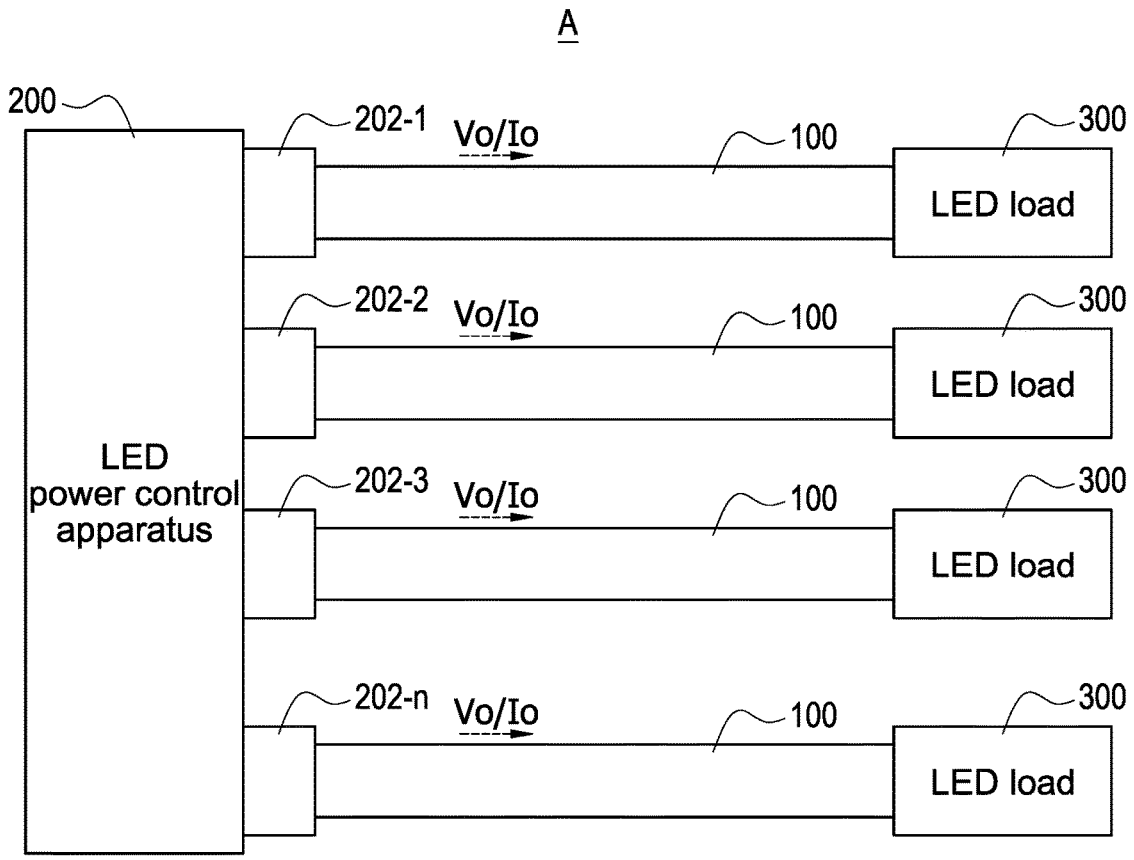
FIG. 1 is a block diagram of an LED power supply system according to the present disclosure.

Reference will now be made to the drawing figures to describe the present disclosure in detail. It will be understood that the drawing figures and exemplified embodiments of present disclosure are not limited to the details thereof.

Please refer to FIG. 1, which shows a block diagram of an LED power supply system according to the present disclosure. The LED power supply system A includes a plurality of LED power transmission lines 100, an LED power control apparatus 200, and a plurality of LED loads 300. The LED power transmission lines 100 are correspondingly coupled to a plurality of power output ports 202-1 to **202-*n* of the LED power control apparatus 200 and the LED loads 300 so that the LED power control apparatus 200 is coupled to the LED loads 300 through the LED power transmission lines 100. In particular, any one of the LED power transmission lines 100 may be coupled to any one of the power output ports 202-1 to 202-*n* to transmit an output voltage Vo and output current Io provided from the power output port 202-1 to 202-*n* to the corresponding LED load 300. The LED power control apparatus 200 limits the sum of the output current Io outputted from the power output ports 202-1 to 202-*n* according to its own power supply capacity, and the user can manually adjust the output current Io outputted from each power output port 202-1 to 202-*n* by themselves. In particular, the LED load 300 is, for example but not limited to, a load having LED elements such as LED lamps and LED light strings. In one embodiment of the present disclosure, the type of the LED load 300** is not limited.

Figure 2:
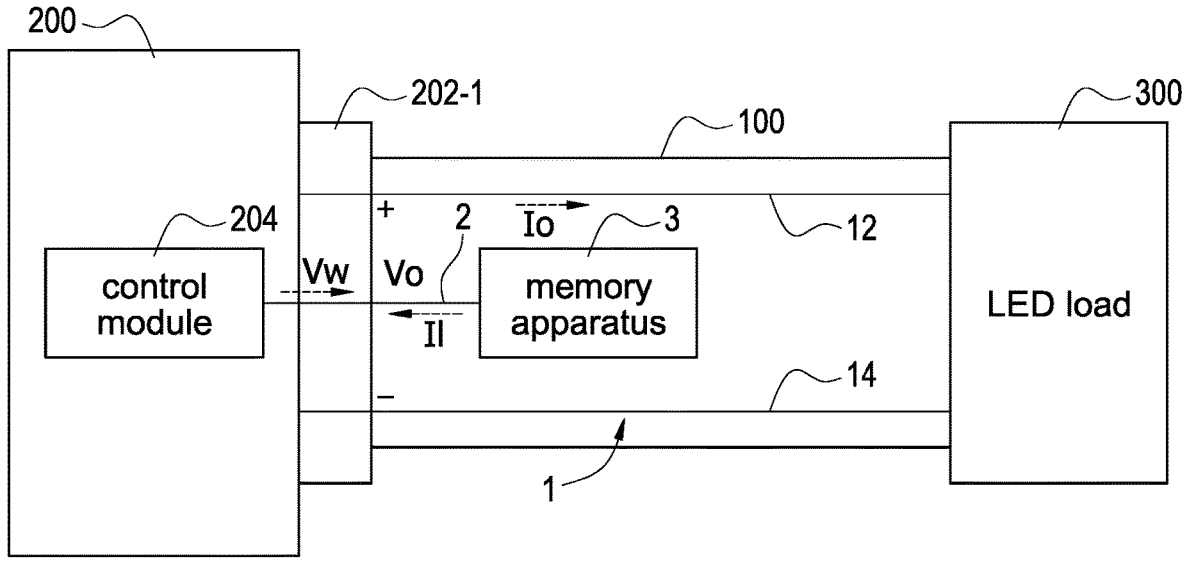
FIG. 2 is a block diagram of an LED power transmission line according to the present disclosure.

Please refer to FIG. 2, which shows a block diagram of an LED power transmission line according to the present disclosure, and also refer to FIG. 1. The LED power transmission line 100 includes a power transmission circuit 1, a signal transmission circuit 2, and a memory apparatus 3. The power transmission circuit 1 includes a transmission bus line 12 and a transmission ground line 14. One end of the transmission bus line 12 and one end of the transmission ground line 14 are coupled to the power output port 202-1 to **202-*n* of the LED power control apparatus 200, and the other end of the transmission bus line 12 and the other end of the transmission ground line 14 are coupled to the LED load 300 to form a power-supplying loop for the LED load 300. The LED power control apparatus 200 includes a control module 204, and the control module 204 controls the LED power control apparatus 200 to convert the input voltage Vin into the output voltage Vo so as to provide the output voltage Vo to the power output ports 202-1 to 202-*n*. The control module 204 may be an apparatus or a circuit that can realized logic control functions, for example but not limited to, a microcontroller (MCU), a system on a chip (Soc), or a control circuit composed of a control chip and peripheral circuits. The LED power transmission line 100 transmits the output voltage Vo, the output current Io outputted from the power output ports 202-1 to 202-*n* to the LED loads 300 through the transmission bus line 12 for the LED loads 300 to perform light-emitting behavior, for example but not limited to, brightness change or flicking. In one embodiment, the power transmission circuit 1 and the signal transmission circuit 2** may be lines (wires) shown in FIGs., or they may be also circuits that simply process power or signals.

One end of the memory apparatus 3 is coupled to the control module 204 through the signal transmission circuit 2, and the other end of the memory apparatus 3 is coupled to the transmission ground line 14. The memory apparatus 3 is used to store LED specification information Il related to electrical specification of the LED load 300. When the LED power transmission line 100 is coupled to any one of the power output ports 202-1 to **202-*n*, the memory apparatus 3 receives a working voltage Vw provided from the control module 204 through the signal transmission circuit 2 (to work) to provide the LED specification information Il to the control module 204. In particular, the working voltage Vw may be, for example but not limited to, provided by the microcontroller itself in the control module 204, or provided by the control module 204 with a micro battery or an external power supply. The LED specification information Il may include electrical specification of the LED load 300, such as voltage specification, current specification, power specification, or strobotac specification. In one embodiment, the LED power transmission line 100 is, for example but not limited to, based on current limitation specification. When the control module 204 receives the LED specification information Il, the control module 204 limits the output current Io outputted from the power output port 202-1 to 202-*n* according to the LED specification information Il to meet the electrical specification of the LED load 300, thereby avoiding damaging the LED load 300 due to the excessive receiving current of the LED load 300. In one embodiment, the memory apparatus 3** may be an apparatus with the function of storing memory data, such as a memory chip, an electrically-erasable programmable read-only memory (EEPROM), or so on.

Take the LED power transmission line 100 coupled to the power output port 202-1 and the LED load 300, and the current specification of the LED load 300 with 0.3 amperes as an example, and it is assumed that the output current Io outputted from the power output port 202-1 is limited to a current limit value with 1.2 amperes (that is, the output current Io shall not exceed 1.2 amperes. When the LED power transmission line 100 coupled to the LED load 300 is coupled to the power output port 202-1 of the LED power control apparatus 200, the control module 204 provides the working voltage to the memory apparatus 3 through the signal transmission circuit 2 so that the memory apparatus 3 starts to work to provide the LED specification information Il to the signal transmission circuit 2. The control module 204 receives the LED specification information Il through the signal transmission circuit 2 to realize that the current specification of the LED load 300 is 0.3 amperes according to the LED specification information Il. Afterward, the control module 204 controls the LED power control apparatus 200 to adjust the limitation of the output current Io of the power output port 202-1 from the default current limit value (i.e., 1.2 amperes) to a rated current value (i.e., 0.3 amperes) according to the current specification of the LED load 300 so as to meet the electrical specification of the LED load 300. Therefore, it to save the user manually sets the current output limit parameters of each power output port 202-1 to **202-*n*, thereby preventing the LED load 300 from being damaged due to the excessive receiving output current (1.2 amperes) of the LED load 300**.

In one embodiment, the LED specification information Il provided by the memory apparatus 3 is not only used for limiting the output current Io of the LED power control apparatus 200, but also depends on the characteristics of the LED power control apparatus 200 and the LED load 300. Specifically, the control module 204 of the LED power control apparatus 200 receives the LED specification information Il through the signal transmission circuit 2 to adjust the output voltage Vo and the output power outputted from the power output port 202-1 to **202-*n* according to the LED specification information Il. Moreover, when the LED load 300 needs to perform light-emitting behavior (for example, brightness change or flicking) and the LED power control apparatus 200 can also control the light-emitting behavior of the LED load 300, the control module 204 adjusts the output voltage Vo of the output power outputted from the power output port 202-1 to 202-*n* according to the LED specification information Il to control the flicking frequency of the LED load 300. In one embodiment, the control module 204 and the LED load 300 may also have a function of power line communication (PLC). When the LED power control apparatus 200 is coupled to the LED load 300 through the LED power transmission line 100, the control module 204 may communicate with the LED load 300 through the LED power transmission line 100 to realize the output voltage Vo required by the LED load 300, and limit the output current Io outputted from the LED power control apparatus 200** according to the LED specification information Il.

Specifically, the memory apparatus arranged inside the LED power transmission line 100 needs to burn in advance the LED specification information Il related to the corresponding LED load 300. In actual construction configuration of the LED lighting system, the LED power transmission line 100 is equipped with the LED load corresponding to the LED specification information stored in the memory apparatus 3, and is coupled to the LED power control apparatus 200 capable of reading data stored in the memory apparatus 3 so that the LED power control apparatus automatically adjusts the output current of each power output port 202-1 to **202-*n* according to the LED specification information acquired from each power output port 202-1 to 202-*n*. Therefore, the main purpose and effect of the present disclosure are that the user not only does not need to work hard to set the output current limit value of each power output port 202-1 to 202-*n* during the installation and adjustment stage of the LED lighting system, but also does not have to worry about the LED load 300 being burned by mistakenly connecting the LED load 300 that does not meet the set value after setting the parameters. For the fault repair and maintenance process of the LED load 300, the user only needs to consider purchasing the same specification of the LED load 300** and directly replace it, thereby saving the effort of resetting parameters for adjustment and improving the convenience of overall system configuration and maintenance.

Figure 3A:
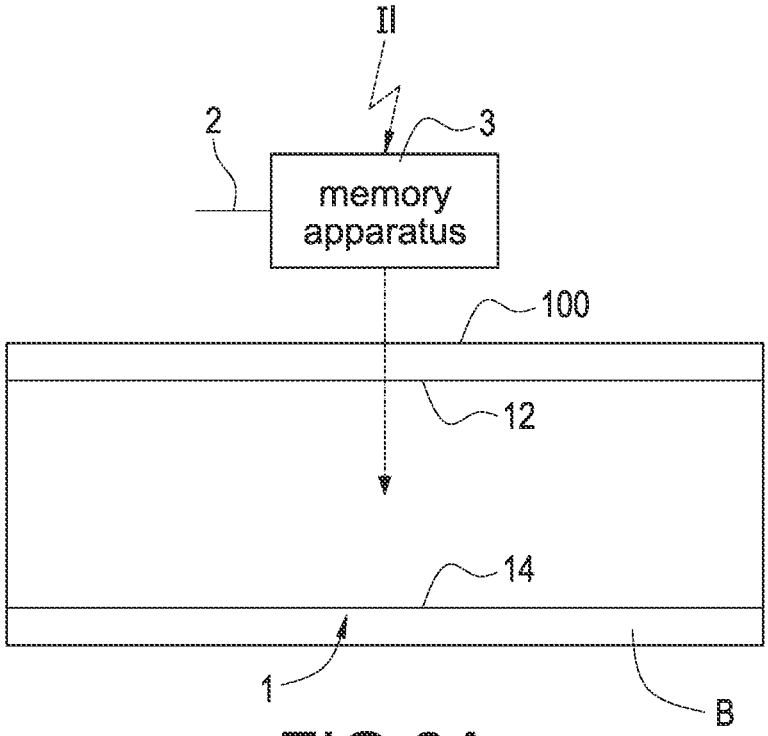
FIG. 3A is a schematic block diagram of burning an LED specification information according to a first embodiment of the present disclosure.
Figure 3B:
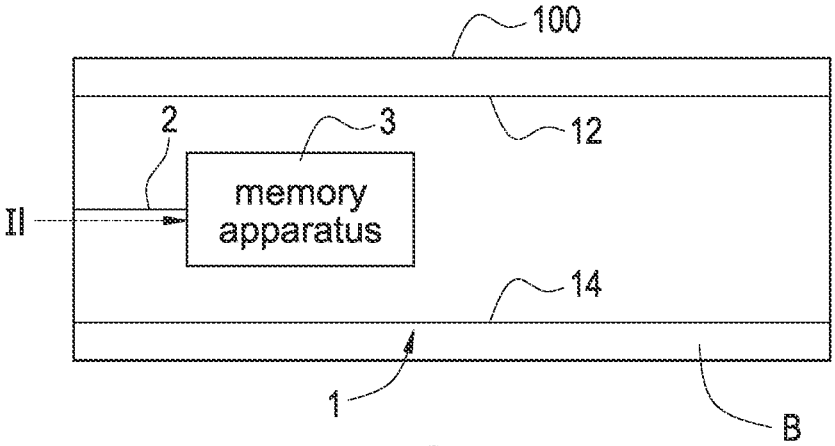
FIG. 3B is a schematic block diagram of burning the LED specification information according to a second embodiment of the present disclosure.
Figure 3C:
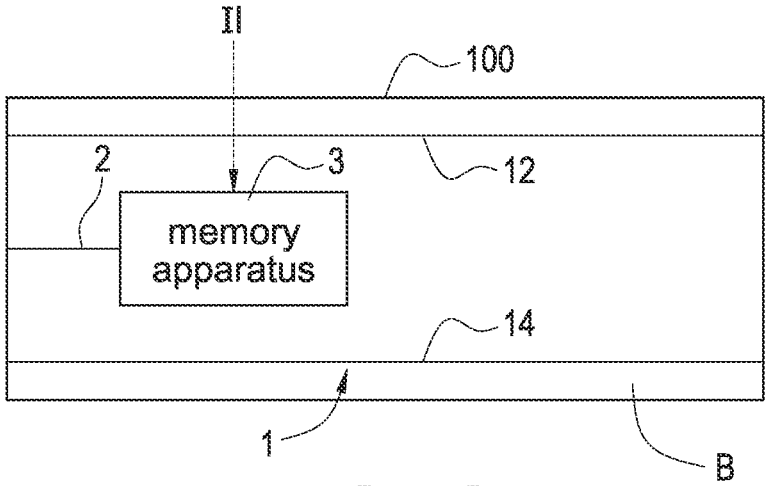
FIG. 3C is a schematic block diagram of burning the LED specification information according to a third embodiment of the present disclosure.

Please refer to FIG. 3A, which shows a schematic block diagram of burning an LED specification information according to a first embodiment of the present disclosure, FIG. 3B, which shows a schematic block diagram of burning the LED specification information according to a second embodiment of the present disclosure, FIG. 3C, which shows a schematic block diagram of burning the LED specification information according to a third embodiment of the present disclosure, and also refer to FIG. 1 to FIG. 2. In FIG. 3A, before the LED power transmission line 100 leaves the factory, the LED specification information Il may be turned in advance into the memory apparatus 3 (burning is indicated by dotted lines). After the burning is completed, the memory apparatus 3 is welded to the signal transmission circuit 2 and the transmission ground line 14. Finally, the power transmission circuit 1, the signal transmission circuit 2, and the memory apparatus 3 are packaged in a wire B to form the LED power transmission line 100. Therefore, when the LED power transmission line 100 leaves the factory, it can provide an external apparatus to identify the LED load 300 which is matched with the external apparatus.

The difference between the embodiment of the FIG. 3B and that of the FIG. 3A is that: before the LED power transmission line 100 leaves the factory, the memory apparatus 3 may be welded to the signal transmission circuit 2 and the transmission ground line 14, and then the power transmission circuit 1, the signal transmission circuit 2, and the memory apparatus 3 are packaged in the wire B to form the LED power transmission line 100. Afterward, the LED specification information Il is burned in advance into the memory apparatus 3 (burning is indicated by dotted lines) through the signal transmission circuit 2. Therefore, when the LED power transmission line 100 leaves the factory, it can provide the external apparatus to identify the LED load 300 which is matched with the external apparatus.

The difference between the embodiment of the FIG. 3C and that of the FIG. 3A is that: before the LED power transmission line 100 leaves the factory, the memory apparatus 3 may be welded to the signal transmission circuit 2 and the transmission ground line 14, and then the power transmission circuit 1, the signal transmission circuit 2, and the memory apparatus 3 are packaged in the wire B to form the LED power transmission line 100. Afterward, the LED specification information Il is burned in advance into the memory apparatus 3 (burning is indicated by dotted lines) through a wireless manner, such as photo coupler, Bluetooth, or Wi-Fi. Therefore, when the LED power transmission line 100 leaves the factory, it can provide the external apparatus to identify the LED load 300 which is matched with the external apparatus.

Figure 4:
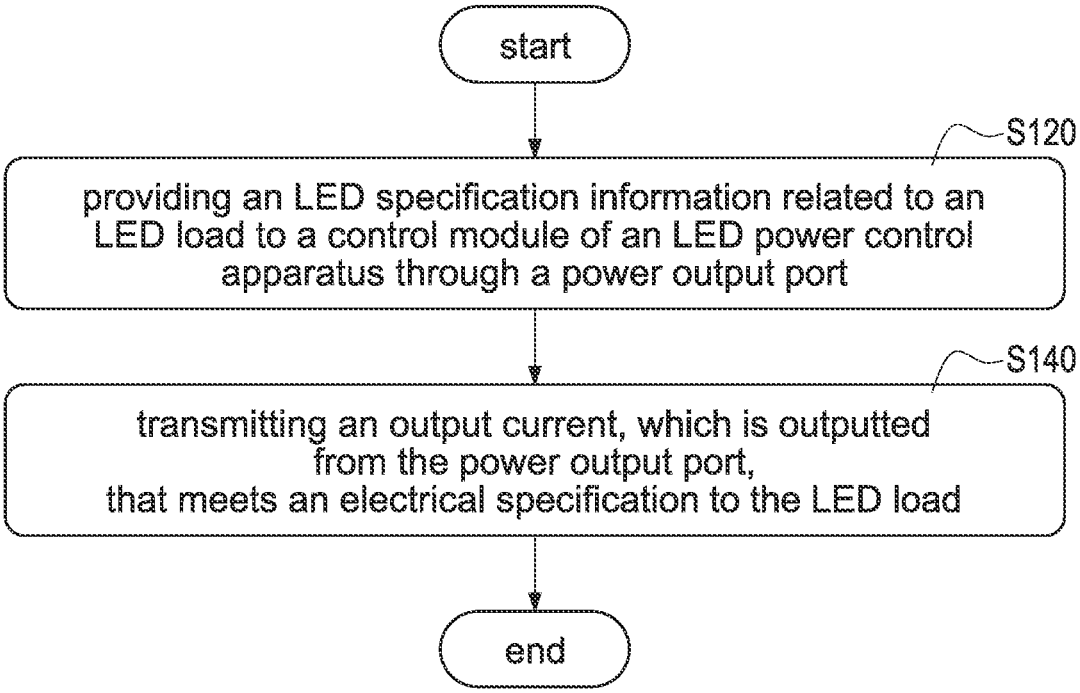
FIG. 4 is a flowchart of a load identification method for the LED transmission line according to present disclosure.

Please refer to FIG. 4, which shows a flowchart of a load identification method for the LED transmission line according to present disclosure, and also refer to FIG. 1 to FIG. 3C. The load identification method is mainly applied to the LED power supply system A, and the LED power transmission line 100 of the LED power supply system A is coupled between any power output port 202-1 to **202-*n* of the LED power control apparatus 200 and the LED load 300 so that the output voltage Vo and the output current Io outputted from the power output port 202-1 to 202-*n* is provided to the LED load 300 through the LED power transmission line 100. The load identification method includes steps of: providing an LED specification information related to the LED load to the control module of the LED power control apparatus through the power output port (S120). Specifically, the memory apparatus 3 of the LED power transmission line 100 transmits the LED specification information Il related to the LED load 300 to the control module 204 of the LED power control apparatus 200 through a transmission path between the signal transmission circuit 2 and the power output port 202-1 to 202-*n* so that the control module 204 controls the LED power control apparatus 200. The memory apparatus 3 receives the working voltage Vw provided from the control module 204 through the signal transmission circuit 2 (to work) to provide the LED specification information Il to the control module 204. In particular, as shown in FIG. 3A to FIG. 3C, the LED specification information Il may be burned in advance into the memory apparatus 3**.

Finally, the output current, which is outputted from the power output port, that meets the electrical specification is transmitted to the LED load (S140). Specifically, the control module 204 controls the LED power control apparatus 200 to adjust the limitation of the output current outputted from the power output port 202-1 to **202-*n* from the current limit value to the rated current value so as to meet the electrical specification of the LED load 300, thereby preventing the LED load 300 from being damaged due to the excessive receiving output current (1.2 amperes) of the LED load 300**.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. An LED power transmission line with load identification function coupled to an LED power control apparatus having a plurality of power output ports and an LED load, the LED power transmission line comprising:

a power transmission circuit coupled to any one of the power output ports and the LED load, and configured to transmit a power outputted from the power output port to the LED load, a signal transmission circuit coupled to a control module of the LED power control apparatus through the power output port, and a memory apparatus coupled to the signal transmission circuit, and configured to store an LED specification information related to the LED load, wherein the control module acquires the LED specification information through the signal transmission circuit, and adjusts an output current outputted from the power output port according to the LED specification information.

2. The LED power transmission line as claimed in claim 1, wherein the power transmission circuit comprises:

a transmission bus line coupled to the power output port and the LED load, and a transmission ground line coupled to the power output port, the LED load, and the memory apparatus, wherein the memory apparatus receives a working power provided from the control module to work through the signal transmission circuit.

3. The LED power transmission line as claimed in claim 1, wherein the LED specification information comprises an electrical specification; the control module controls the LED power control apparatus to adjust the output current according to the electrical specification from a current limit value to a rated current value that meets the electrical specification.

4. The LED power transmission line as claimed in claim 1, wherein the LED specification information is burned in advance in the memory apparatus before the LED power transmission line is packaged.

5. The LED power transmission line as claimed in claim 1, wherein the LED specification information is burned in the memory apparatus by a wireless burning manner after the LED power transmission line is packaged.

6. The LED power transmission line as claimed in claim 1, wherein the LED specification information is burned in the memory apparatus by the signal transmission circuit after the LED power transmission line is packaged.

7. The LED power transmission line as claimed in claim 1, wherein the LED specification information comprises at least one of a voltage specification, a current specification, a power specification, and a strobotac specification of the LED load.

8. A load identification method of an LED power transmission line, the LED power transmission line coupled to any one power output port of an LED power control apparatus having a plurality of power output ports and an LED load, the method comprising steps of:

providing an LED specification information related to the LED load through a signal transmission circuit in the LED power transmission line and stored in a memory apparatus of the LED power transmission line to the LED power control apparatus through the power output port, and controlling the LED power control apparatus to adjust an output current, so as to provide the output current that meets an electrical specification to the LED load through the power output port.

9. The load identification method as claimed in claim 8, further comprising a step of:

providing a working power to the memory apparatus by the LED power control apparatus so that the memory apparatus works to provide the LED specification information.

10. The load identification method as claimed in claim 8, further comprising a step of:

burning in advance the LED specification information in the memory apparatus.

* * * * *